US011060729B2

(12) United States Patent
Roh et al.

(10) Patent No.: US 11,060,729 B2
(45) Date of Patent: Jul. 13, 2021

(54) FUEL NOZZLE ASSEMBLY AND GAS TURBINE COMBUSTOR INCLUDING THE SAME

(71) Applicant: DOOSAN HEAVY INDUSTRIES & CONSTRUCTION CO., LTD., Changwon-si (KR)

(72) Inventors: U Jin Roh, Changwon-si (KR); Mu Hwan Chon, Changwon-si (KR)

( * ) Notice: Subject to any disclaimer, the term of this patent is extended or adjusted under 35 U.S.C. 154(b) by 0 days.

(21) Appl. No.: 16/930,621

(22) Filed: Jul. 16, 2020

(65) Prior Publication Data

US 2021/0080108 A1 Mar. 18, 2021

(30) Foreign Application Priority Data

Sep. 17, 2019 (KR) ..... 10-2019-0114163

(51) Int. Cl.
*F23R 3/28* (2006.01)
*F23R 3/34* (2006.01)
*F23R 3/14* (2006.01)

(52) U.S. Cl.
CPC ..... *F23R 3/286* (2013.01); *F23R 3/14* (2013.01); *F23R 3/34* (2013.01)

(58) Field of Classification Search
CPC .. F23R 3/14; F23R 3/286; F23C 7/004; F23D 11/103; F23D 11/303; F23D 11/383; F23D 2900/14021
See application file for complete search history.

(56) References Cited

U.S. PATENT DOCUMENTS

2008/0083229 A1* 4/2008 Haynes ..... F23R 3/286 60/776
2010/0083664 A1* 4/2010 Mancini ..... F23R 3/286 60/752
2012/0058696 A1* 3/2012 Whitman ..... B62B 15/006 441/66
2012/0167578 A1* 7/2012 Berry ..... F23R 3/286 60/772
2015/0369135 A1* 12/2015 Laster ..... F23R 3/26 60/39.23
2020/0072468 A1* 3/2020 Uhm ..... F23R 3/14

FOREIGN PATENT DOCUMENTS

KR 20190004612 A 1/2019
KR 20190040667 A 4/2019
WO WO-9949264 A1 * 9/1999 ..... F23D 23/00

* cited by examiner

*Primary Examiner* — Ehud Gartenberg
*Assistant Examiner* — Roberto Toshiharu Igue

(57) ABSTRACT

A fuel nozzle assembly and a gas turbine combustor including the same are provided. The fuel nozzle assembly may include an end plate coupled to one end of an annular casing, and a fuel nozzle configured such that one end thereof is supported by the end plate and the other end thereof extends outward. The fuel nozzle may include a center fuel nozzle and a plurality of side fuel nozzles arranged annularly to surround the center fuel nozzle. The side fuel nozzle may include a nozzle body located at a center thereof, a shroud spaced outward from the nozzle body, and a plurality of swirlers located between the nozzle body and the shroud. Each of the swirlers may include a leading edge directed toward the end plate and a trailing edge located opposite the leading edge. In each of the side fuel nozzles, distances between the leading edges are different from each other.

10 Claims, 7 Drawing Sheets

[FIG. 1]
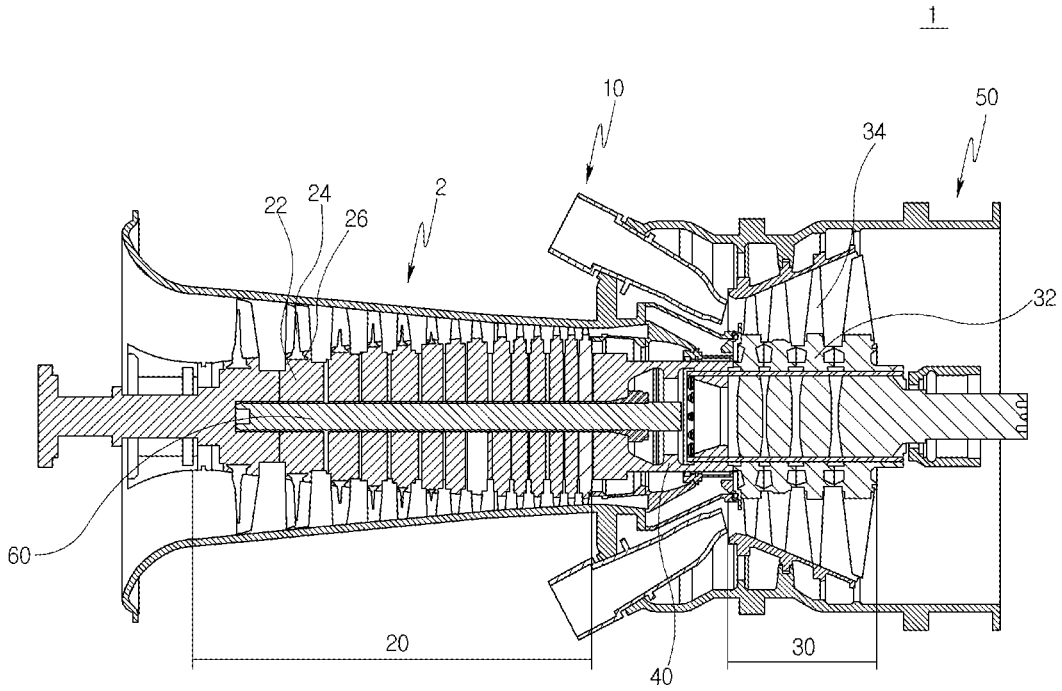

[FIG. 2]
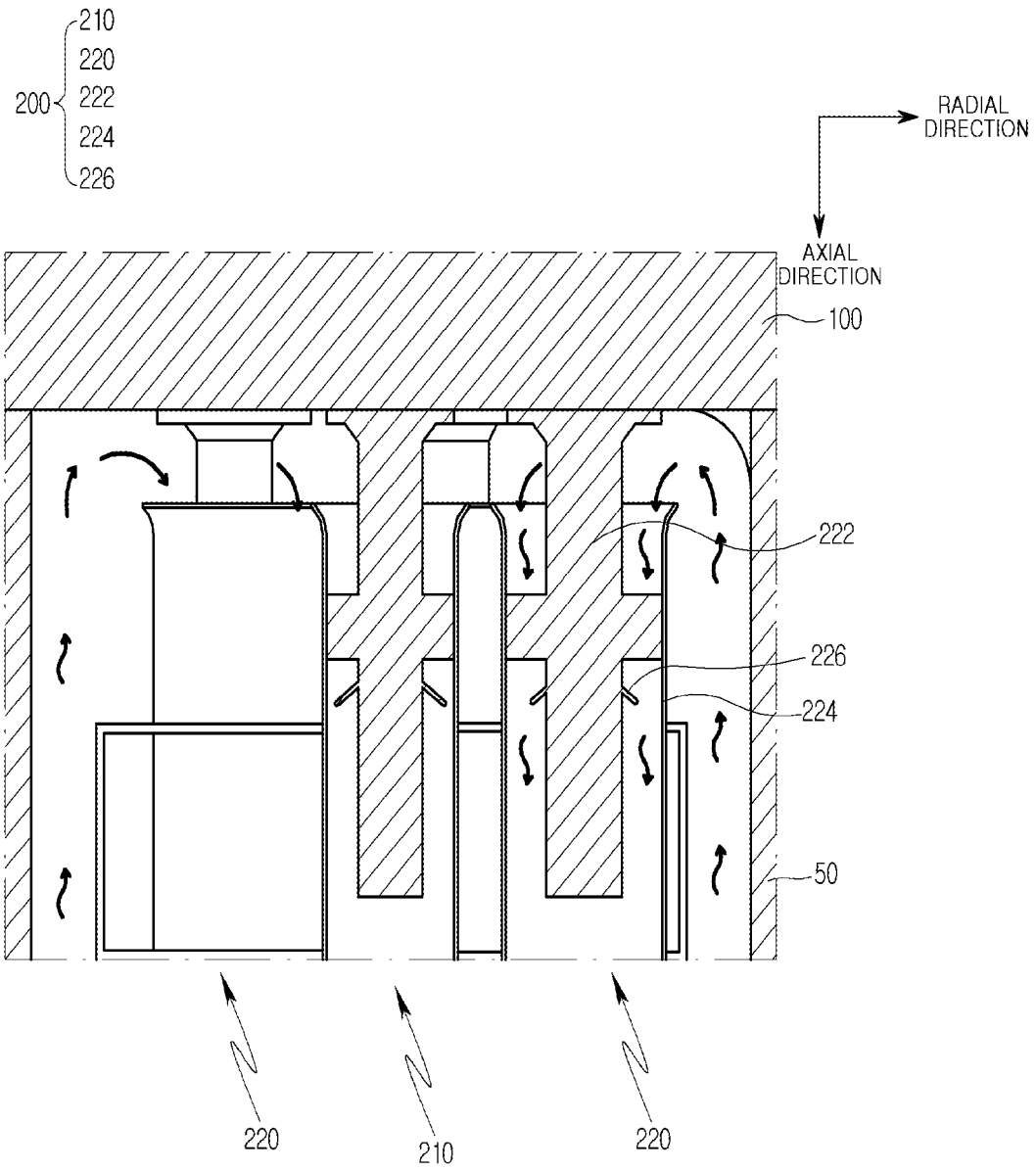

[FIG. 3]
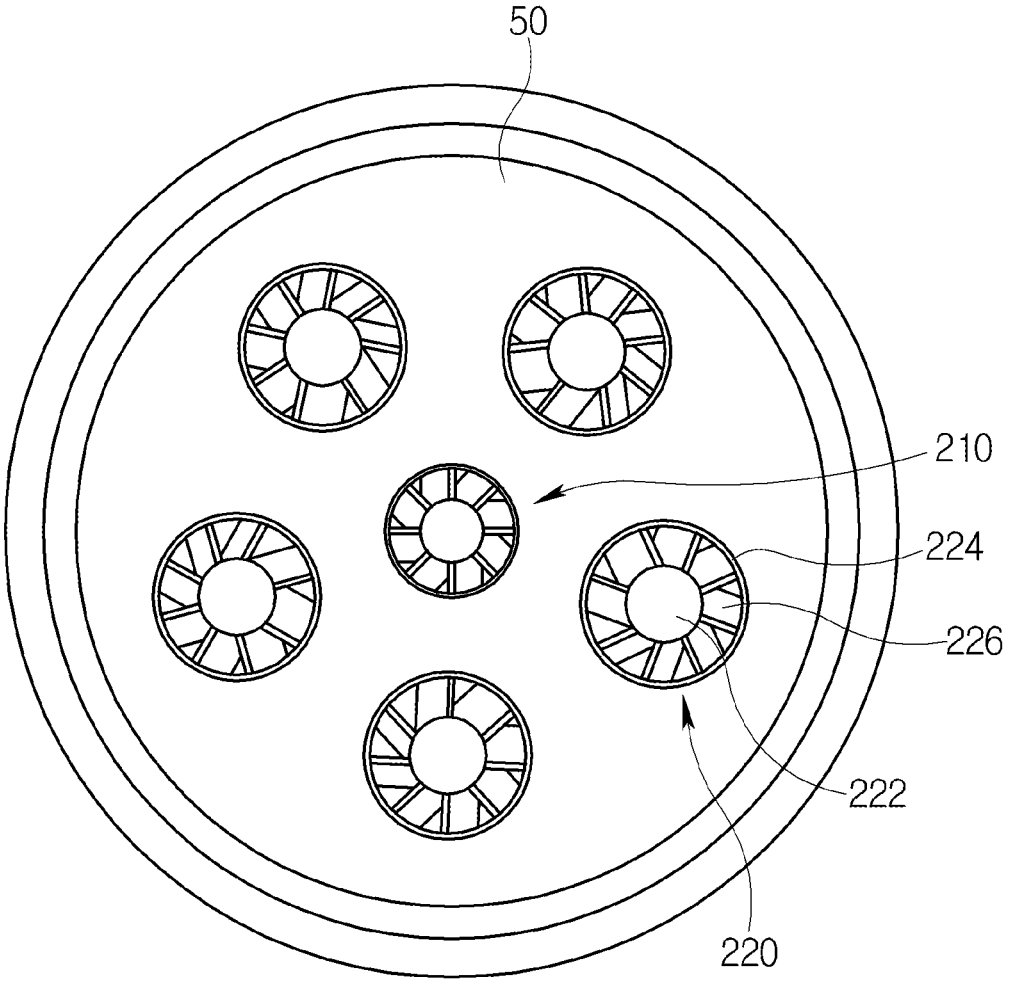

[FIG. 4]
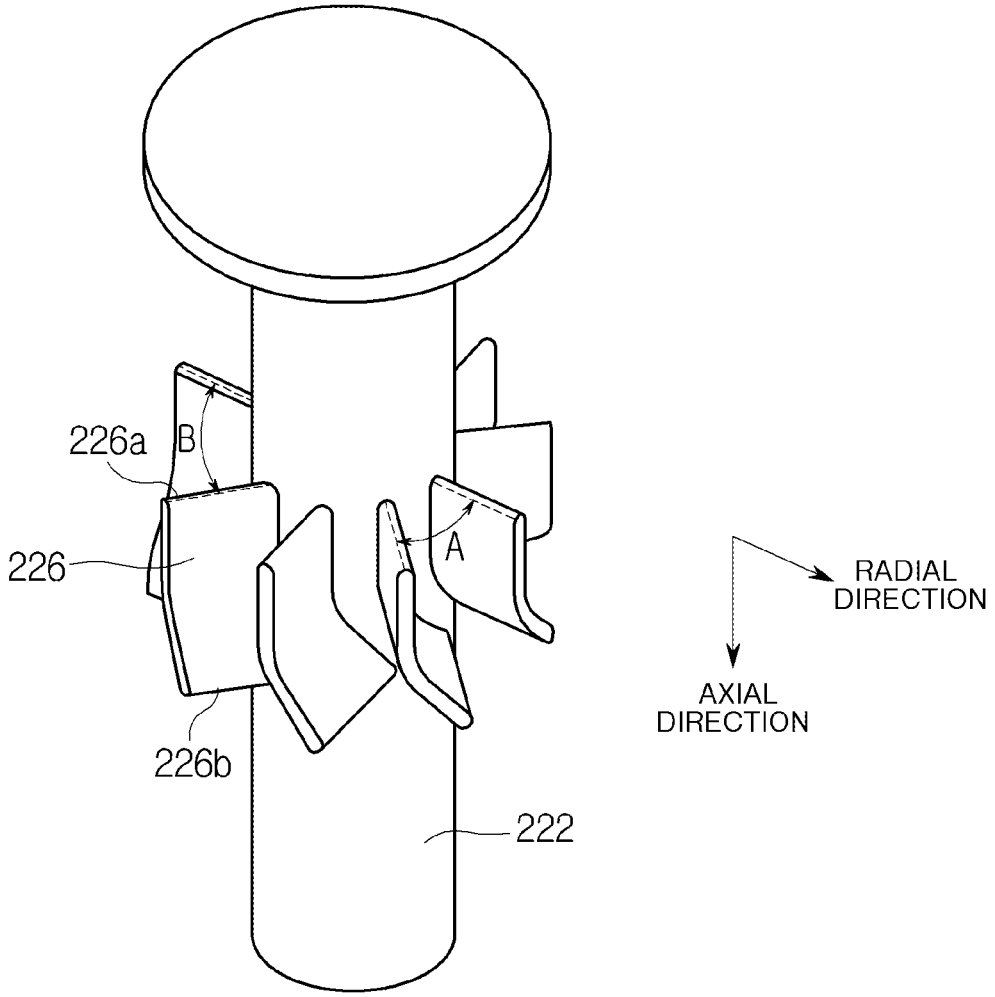

[FIG. 5]
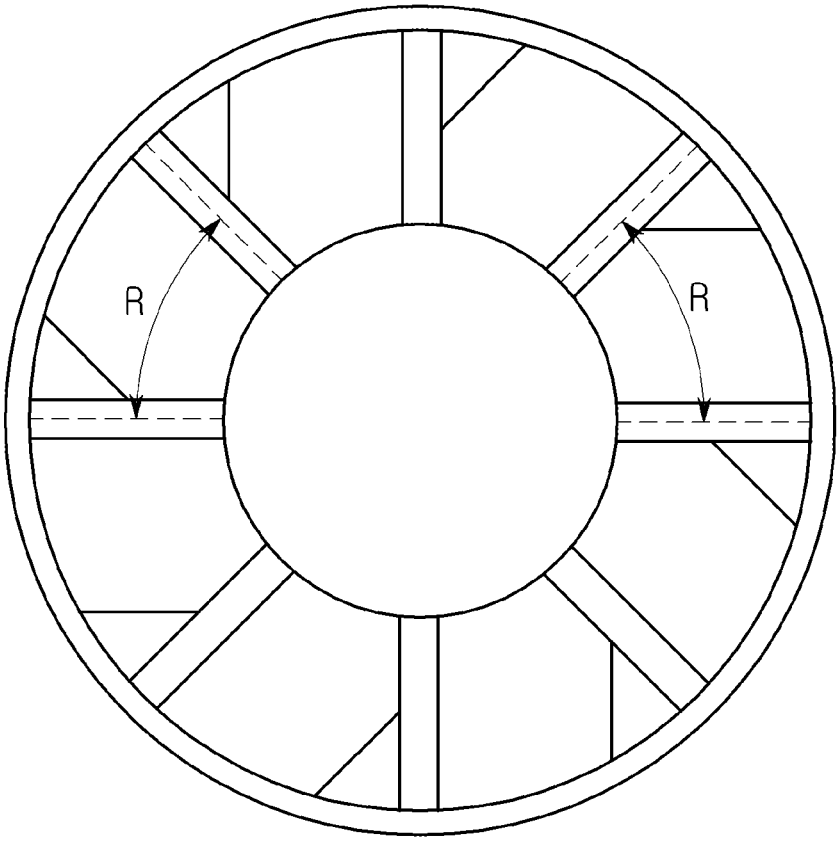
Related Art

[FIG. 6]
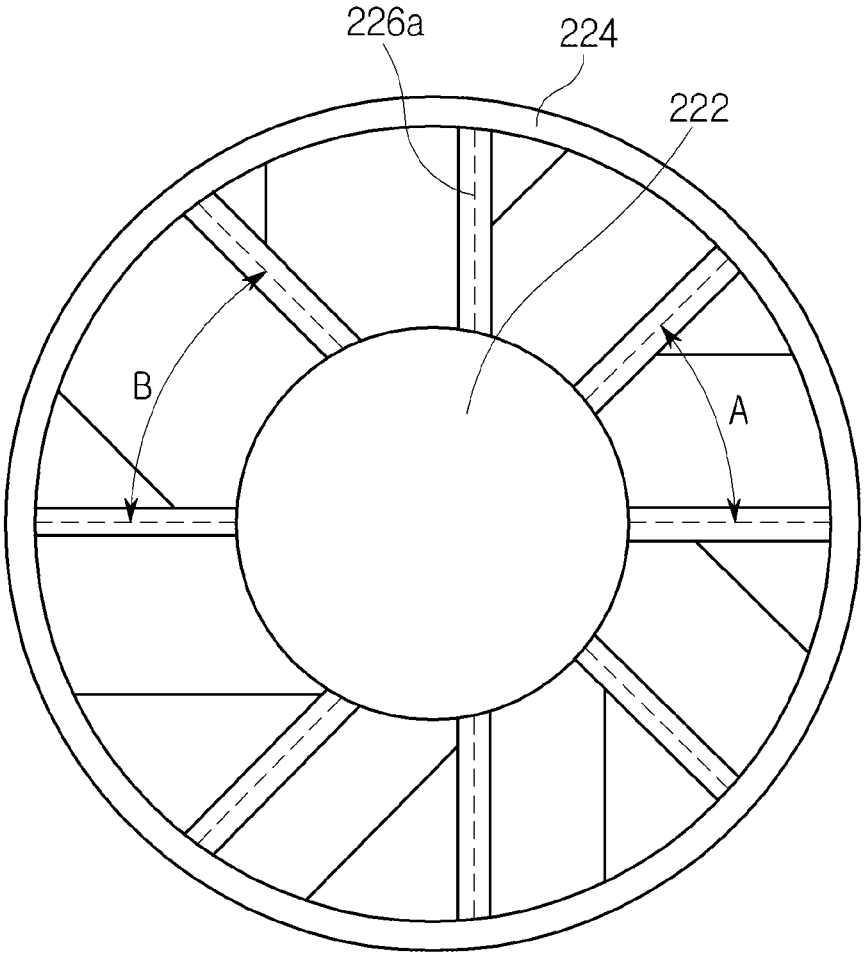

[FIG. 7]
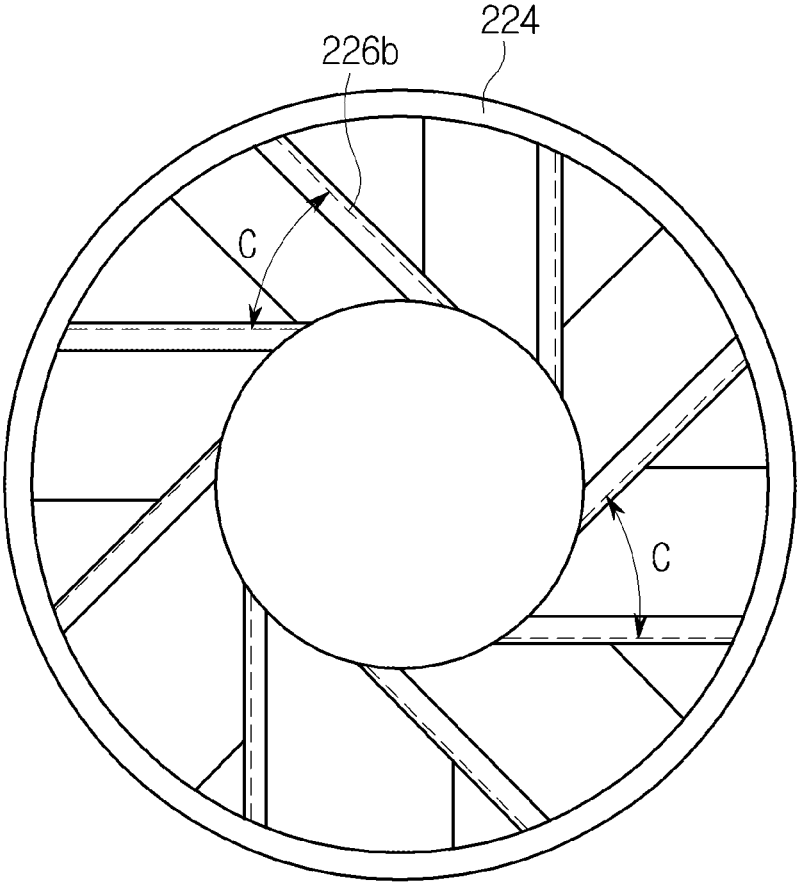

FUEL NOZZLE ASSEMBLY AND GAS TURBINE COMBUSTOR INCLUDING THE SAME

CROSS-REFERENCE TO RELATED APPLICATION

This application claims priority to Korean Patent Application No. 10-2019-0114163, filed on Sep. 17, 2019 the disclosure of which is incorporated herein by reference in its entirety.

BACKGROUND

Field

Apparatuses and methods consistent with exemplary embodiments relate to a fuel nozzle assembly and a gas turbine combustor including the same, and more particularly, to a fuel nozzle assembly for making a uniform flow rate of air passing through fuel nozzles, and a gas turbine combustor including the same.

Description of the Related Art

In general, allowable emissions of nitrogen oxides (NOx) and carbon monoxide (CO) from exhaust during combustion have been steadily reduced in consideration of environmental problems.

In order to achieve low emissions while maintaining high efficiency during combustion, a lean-premix-based combustion system is used. In such a type of system, fuel and compressed air are completely premixed before combustion.

Premixing may be accomplished in several ways, and a mixture of fuel and compressed air has a very lean concentration so that a flame temperature during actual combustion is low enough to minimize a formation of nitrogen oxides (NOx).

However, because the combustion system operates near the lean limit of combustion reaction, it may cause significant problems with combustion stability that do not normally occur in a related art gas turbine which uses a diffusion flame operating at a theoretical fuel/compressed air mixture ratio.

This instability may be caused by an in-combustor fluctuating pressure field that is often amplified through various physical mechanisms involved in an overall design of the combustion system. If a dynamic pressure of air exceeds a predetermined allowable value, this may seriously affect the operation of the gas turbine and/or a mechanical life of the combustion system.

A typical lean premixed combustion system includes a premixing zone, a flame holder, a reaction zone, first-stage gas turbine nozzles, and a fuel and compressed air supply system. In a lean premixed combustion mode thereof, fuel and compressed air are supplied to the premixing zone from separate sources with different dynamic properties. When entering the reaction zone, the premixed fuel/compressed air mixture is ignited by hot gas maintained within the separation zone of the flame holder. The hot gas produced after combustion flows through the first-stage turbine nozzles which accelerate the flow through first-stage turbine blades.

In this case, if the pressure ratio of compressed air and fuel supplied is high, a swirl occurs during the mixing of the fuel and the compressed air, resulting in unstable combustion and thus locally different heat releases. Hence, a fluctuation of the mixing ratio of fuel and compressed air and noise are generated.

In addition, the temperature of gas flow depends on the mixing ratio of fuel and compressed air entering the reaction zone. If the mixing ratio is equal to or higher than the value required for maintaining the reaction, the variation in combustion temperature according to the change of the mixing ratio is almost linear. However, if the mixing ratio approaches and passes the lean limit, the variation in gas temperature according to the change of the mixing ratio becomes much larger until the flame is extinguished.

Moreover, the combustion gas acting as a working fluid for rotating a plurality of turbine blades is produced by premixing and burning compressed air and fuel injected through a fuel nozzle assembly having a plurality of collected fuel nozzles or by directly injecting fuel into compressed air for combustion. In this case, it is important to adequately and appropriately supply compressed air to the fuel nozzles for the combustion of the gas turbine.

For premixed combustion, the compressed air supplied to the fuel nozzles flows toward a nozzle end plate located at a rear end of the fuel nozzle assembly, and is then turned in an opposite direction, so that the air flows to an end of each nozzle in which combustion occurs.

In a case of each side fuel nozzle, located at an edge of the fuel nozzle assembly, from among the plurality of fuel nozzles, the flow rate of air flowing toward a center of the fuel nozzle assembly is larger than the flow rate of air flowing toward an edge of the fuel nozzle assembly. Meanwhile, as illustrated in FIG. 5, a plurality of swirlers are arranged at equal intervals in a related art fuel nozzle, which results in a difference in flow rate between the swirlers through which air flows.

As described above, if the flow rate of air passing through each swirler of a side fuel nozzle varies depending on a position of the swirler, it is difficult to expect uniform mixing of air and fuel as well as causing incomplete combustion in a combustion chamber.

Therefore, there is a need for a method capable of improving the overall efficiency of the gas turbine as well as the combustion efficiency by keeping the flow rate of air uniform in the region in which the air has passed through the swirler (e.g., near a trailing edge of the swirler) in the side fuel nozzle of the gas turbine.

SUMMARY

Aspects of one or more exemplary embodiments provide a fuel nozzle assembly that enables a flow rate of air to be kept uniform in a region in which the air has passed through a swirler in a side fuel nozzle, and a gas turbine combustor including the same.

Additional aspects will be set forth in part in the description which follows and, in part, will become apparent from the description, or may be learned by practice of the exemplary embodiments.

According to an aspect of an exemplary embodiment, there is provided a fuel nozzle assembly including: an end plate coupled to one end of an annular casing, and a fuel nozzle configured such that one end thereof is supported by the end plate and the other end thereof extends outward, compressed air being supplied to the fuel nozzle through an inflow channel in the casing. The fuel nozzle may include a center fuel nozzle located at a center thereof and a plurality of side fuel nozzles arranged annularly to surround the center fuel nozzle. The side fuel nozzle may include a nozzle body located at a center thereof, a shroud spaced outward from the nozzle body and defining a flow path therebetween, and a plurality of swirlers located between the nozzle body and the shroud. Each of the swirlers may include a leading edge directed toward the end plate and a trailing edge located opposite the leading edge. In each of the side fuel nozzles, distances between the leading edges may be different from each other.

In each of the side fuel nozzles, a distance between the leading edges located radially inward of the fuel nozzle assembly may be larger than a distance between the leading edges located radially outward of the fuel nozzle assembly.

In any adjacent ones of the swirlers, distances between the trailing edges may be the same.

The side fuel nozzles may be spaced apart from each other at equal intervals.

Each of the swirlers may be bent at least once from the leading edge to the trailing edge.

In any of the side fuel nozzles, the bent portions of the swirlers may have different curvatures.

Each of the swirlers may include a cavity and a fuel injection hole which is formed on surface and is open from the cavity.

The swirler may be coupled in communication with the nozzle body so that some of the fuel flowing in the nozzle body is supplied to the cavity of the swirler and injected through the fuel injection hole.

A diameter of the side fuel nozzle may be larger than a diameter of the center fuel nozzle.

An angle formed by adjacent leading edges in a region in which there is the largest one of the distances between the leading edges may be greater than an angle formed by adjacent leading edges in a region in which there is the smallest one of the distances between the leading edges.

At least one of the swirlers may be configured such that the leading edge thereof is positioned to coincide with the radial direction of the fuel nozzle assembly.

At least one of the swirlers may be configured such that the trailing edge thereof is positioned to coincide with the radial direction of the fuel nozzle assembly.

The swirlers may include an even number of swirlers, and the leading edges may be arranged to be symmetrical with respect to the radial direction of the fuel nozzle assembly.

The trailing edges may be arranged to be symmetrical with respect to the radial direction of the fuel nozzle assembly.

According to an aspect of another exemplary embodiment, there is provided a gas turbine combustor including: a combustion chamber and a fuel nozzle assembly mounted to the combustion chamber. The fuel nozzle assembly may include an end plate coupled to one end of an annular casing and a fuel nozzle configured such that one end thereof is supported by the end plate and the other end thereof extends outward, compressed air being supplied to the fuel nozzle through an inflow channel in the casing. The fuel nozzle may include a center fuel nozzle located at a center thereof and a plurality of side fuel nozzles arranged annularly to surround the center fuel nozzle. The side fuel nozzle may include a nozzle body located at a center thereof, a shroud spaced outward from the nozzle body and defining a flow path therebetween, and a plurality of swirlers located between the nozzle body and the shroud. Each of the swirlers may include a leading edge directed toward the end plate and a trailing edge located opposite the leading edge. In each of the side fuel nozzles, distances between the leading edges may be different from each other.

In each of the side fuel nozzles, a distance between the leading edges located radially inward of the fuel nozzle assembly may be larger than a distance between the leading edges located radially outward of the fuel nozzle assembly.

In any adjacent ones of the swirlers, distances between the trailing edges may be the same.

According to an aspect of another exemplary embodiment, there is provided a gas turbine including: a compressor configured to compress air externally introduced, a combustor configured to mix fuel with the compressed air compressed and to combust a mixture thereof, and a turbine configured to generate power with combustion gas supplied from the combustor. The combustor may include a combustion chamber and a fuel nozzle assembly mounted to the combustion chamber. The fuel nozzle assembly may include an end plate coupled to one end of an annular casing and a fuel nozzle configured such that one end thereof is supported by the end plate and the other end thereof extends outward, compressed air being supplied to the fuel nozzle through an inflow channel in the casing. The fuel nozzle may include a center fuel nozzle located at a center thereof and a plurality of side fuel nozzles arranged annularly to surround the center fuel nozzle. The side fuel nozzle may include a nozzle body located at a center thereof, a shroud spaced outward from the nozzle body and defining a flow path therebetween, and a plurality of swirlers located between the nozzle body and the shroud. Each of the swirlers may include a leading edge directed toward the end plate and a trailing edge located opposite the leading edge. In each of the side fuel nozzles, distances between the leading edges may be different from each other.

In each of the side fuel nozzles, a distance between the leading edges located radially inward of the fuel nozzle assembly may be larger than a distance between the leading edges located radially outward of the fuel nozzle assembly.

In any adjacent ones of the swirlers, distances between the trailing edges may be the same.

BRIEF DESCRIPTION OF THE DRAWINGS

The above and other aspects will become more apparent from the following description of the exemplary embodiments with reference to the accompanying drawings, in which:

FIG. 1 is a cross-sectional view illustrating a gas turbine according to an exemplary embodiment;

FIG. 2 is a longitudinal cross-sectional view illustrating a fuel nozzle assembly according to an exemplary embodiment;

FIG. 3 is a top view illustrating the fuel nozzle assembly according to an exemplary embodiment;

FIG. 4 is a perspective view illustrating a nozzle body and swirlers in one side fuel nozzle according to an exemplary embodiment;

FIG. 5 is a top view of a related art side fuel nozzle when viewed from a leading edge thereof;

FIG. 6 is a top view of a side fuel nozzle when viewed from a leading edge thereof according to an exemplary embodiment; and FIG. 7 is a top view of a side fuel nozzle when viewed from a trailing edge thereof according to an exemplary embodiment.

DETAILED DESCRIPTION

Various modifications may be made to the embodiments of the disclosure, and there may be various types of embodiments. Thus, specific embodiments will be illustrated in the accompanying drawings and the embodiments will be described in detail in the description. However, it should be noted that the various embodiments are not for limiting the scope of the disclosure to a specific embodiment, but they should be interpreted to include all modifications, equivalents or alternatives of the embodiments included in the ideas and the technical scopes disclosed herein. Meanwhile, in case it is determined that in describing the embodiments, detailed explanation of related known technologies may unnecessarily confuse the gist of the disclosure, the detailed explanation will be omitted.

The terminology used herein is for the purpose of describing particular embodiments only and is not intended to limit the scope of the disclosure. As used herein, the singular forms "a", "an", and "the" are intended to include the plural forms as well, unless the context clearly indicates otherwise. In this specification, terms such as "comprise", "include", or "have/has" should be construed as designating that there are such features, integers, steps, operations, elements, components, and/or a combination thereof in the specification, not to exclude the presence or possibility of adding one or more of other features, integers, steps, operations, elements, components, and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinafter, a fuel nozzle assembly and a gas turbine combustor including the same according to exemplary embodiments will be described with reference to the accompanying drawings. In order to clearly illustrate the disclosure in the drawings, some of the elements that are not essential to the complete understanding of the disclosure may be omitted, and like reference numerals refer to like elements throughout the specification.

FIG. 1 is a cross-sectional view illustrating a gas turbine according to an exemplary embodiment. FIG. 2 is a longitudinal cross-sectional view illustrating a fuel nozzle assembly according to the exemplary embodiment. FIG. 3 is a top view illustrating the fuel nozzle assembly according to the exemplary embodiment. FIG. 4 is a perspective view illustrating a nozzle body and swirlers in one side fuel nozzle according to the exemplary embodiment.

Referring to FIG. 1, the gas turbine 1 includes a compressor 20 that compresses air, a combustor 10 that mixes fuel with the air compressed by the compressor 20 to combust a mixture thereof, and a turbine 30 that generates electric power by rotating turbine blades with high-temperature and high-pressure combustion gas discharged from the combustor 10.

The gas turbine 1 includes a housing 2. Based on a direction of compressed air flow, the compressor 20 is disposed upstream of the housing 2 and the turbine 30 is disposed downstream of the housing 2. A rotational force transmission mechanism 40 serving as a torque transmission member for transferring the torque generated in the turbine 30 to the compressor 20 is disposed between the compressor 20 and the turbine 30.

The gas turbine 1 includes a diffuser 50 in a rear of the housing 2 to discharge the combustion gas passing through the turbine 30. The combustor 10 is disposed in front of the diffuser 50 to receive the compressed air for combustion.

The compressor 20 includes a plurality of compressor rotor disks 22 each of which is fastened by a tie rod 60 to prevent axial separation in an axial direction of the tie rod 60.

The tie rod 60 is disposed to pass through centers of the compressor rotor disks 22. One end of the tie rod 60 is fastened to the most upstream compressor rotor disk 22, and the other end thereof is fixed into the rotational force transmission mechanism 40.

It is understood that the type of the tie rod 60 may not be limited to the example illustrated in FIG. 1, and may be changed or vary according to one or more other exemplary embodiments. For example, there are three types of tie rods: a single-type in which a single tie rod extends through the centers of the compressor rotor disks; a multi-type in which multiple tie rods are arranged circumferentially; and a complex type in which the single-type and the multi-type are combined.

The compressor rotor disks 22 are arranged in the axial direction in a state in which the tie rod 60 extends through the central holes of the compressor rotor disks 22. Here, the adjacent compressor rotor disks 22 are disposed so as not to rotate relative to each other by pressing facing surfaces thereof using the tie rod 60.

Each of the compressor rotor disks 22 may include a plurality of compressor blades 24 radially coupled to the outer peripheral surface thereof. Each of the compressor blades 24 has a root 26 and is fastened to an associated compressor rotor disk 22 therethrough.

Examples of fastening through the root 26 may include a tangential type and an axial type, which may be selected according to the structure required for the gas turbine used. The root 26 may have a dovetail shape and a fir-tree shape.

In some cases, the compressor blade 24 may be fastened to the compressor rotor disk 22 by using other types of fasteners, such as, a key or a bolt.

A plurality of compressor vanes fixed to the inner circumferential surface of the housing 2 are positioned between the respective compressor rotor disks 22. While the compressor rotor disks 22 rotate along with a rotation of the tie rod 60, the compressor vanes fixed to the housing 2 do not rotate. The compressor vanes serve to align the flow of compressed air passing through the compressor blades 24 of an associated compressor rotor disk 22 and to guide the compressed air to the compressor blades of a downstream compressor rotor disk.

As described above, after outside air is sucked into the compressor 20 and compressed in a multistage manner while passing through the compressor blades 24 and compressor vanes, the compressed air may be supplied via the combustor 10 to the turbine 30.

In order to increase the pressure of a fluid in the compressor 20 of the gas turbine and then adjust the angle of flow of the fluid, entering into an inlet of the combustor 10, to a design angle of flow, a deswirler serving as a guide vane may be installed next to the diffuser 50.

The combustor 10 mixes fuel with the introduced compressed air and burns a mixture thereof to produce high-temperature and high-pressure combustion gas with high energy. The temperature of the combustion gas is increased to a heat-resistant limit of the components of the combustor 10 and turbine 30 through an isobaric combustion process.

The combustion system of the gas turbine may include a plurality of combustors 10 arranged in a circumferential direction of the gas turbine 1. Each combustor 10 includes a burner having a fuel injection nozzle, a combustor liner defining a combustion chamber, and a transition piece serving as a connector between the combustor 10 and the turbine 30.

The combustor liner provides a combustion space in which the fuel injected by the fuel injection nozzle and the compressed air supplied from the compressor 20 are mixed and burned. The combustor liner includes a flame cylinder configured to provide the combustion space in which the mixture of fuel and compressed air is burned, and a flow sleeve configured to surround the flame cylinder and provide an annular space therebetween.

The fuel injection nozzle is coupled to a front end of the combustor liner, and an ignition plug is coupled to a sidewall of the combustor liner.

The transition piece is connected to a rear end of the combustor liner to transfer the combustion gas to the turbine 30. In order to prevent the transition piece from being damaged due to the high temperature of the combustion gas, an outer wall of the transition piece is cooled by the compressed air supplied from the compressor 20.

The high-temperature and high-pressure combustion gas ejected from the combustor 10 is supplied to the turbine 30. The supplied high-temperature and high-pressure combustion gas expands and provides an impingement or a reaction force to the turbine blades of the turbine to generate a rotational torque. A portion of the rotational torque is transmitted via the rotational force transmission mechanism 40 to the compressor 20, and the remaining portion which is the excessive rotational torque is used to drive a generator or the like.

The turbine 30 is basically similar to the structure of the compressor 20. That is, the turbine 30 may include a plurality of turbine rotor disks 32 similar to the compressor rotor disks 22 of the compressor, and the turbine rotor disk 32 may include a plurality of turbine blades 34 disposed radially. In this case, the turbine blades 34 may be coupled to the turbine rotor disk 34 in a dovetail coupling manner.

In addition, a plurality of turbine vanes may be provided between the respective turbine blades 34 of the turbine rotor disk 32 to guide the flow of combustion gas passing through the turbine blades 34.

In the gas turbine 1, after air is introduced into the compressor 20 to be compressed therein and is used for combustion in the combustor 10, the combustion gas produced in the combustor 10 flows to the turbine 30 to drive the turbine and is discharged to the atmosphere through the diffuser 50.

Referring to FIG. 2, the combustor 10 may include a fuel nozzle 200 to supply and inject fuel. The fuel nozzle 200 including a plurality of fuel nozzles may include a center fuel nozzle 210 located at a center thereof and side fuel nozzles 220 surrounding the center fuel nozzle 210.

To this end, a fuel nozzle assembly according to the exemplary embodiment includes an end plate 100 coupled to one end of an annular casing 50 and the fuel nozzle 200 configured such that one end thereof is supported by the end plate 100 and the other end thereof extends outward, with compressed air being supplied to the fuel nozzle 200 through an inflow channel defined in the casing 50. The compressed air flows between the end plate 100 and the fuel nozzle 200. For example, the compressed air flows toward the end plate 100 within the casing 50 and then flows into the fuel nozzle 200.

The end plate 100 having a disk shape is provided to stably support one end of the fuel nozzle 200.

The fuel nozzle 200 may include a center fuel nozzle 210 located at the center of the end plate 100 and a plurality of side fuel nozzles 220 spaced radially outward from the center fuel nozzle 210 and arranged along an edge of the end plate 100.

Each of the side fuel nozzles 220 includes a tubular nozzle body 222, a tubular shroud 224 spaced radially outward from the nozzle body 222 and surrounding the nozzle body 222, and a swirler 226 positioned between the nozzle body 222 and the shroud 224.

The nozzle body 222 is a cylindrical cylinder, and the shroud 224 is provided outside the nozzle body 22 and is concentric with the nozzle body 222. The shroud 224 is spaced apart from the nozzle body 222 by a predetermined distance so that compressed air flows outside the nozzle body 222. The swirler 226 is fixed to the nozzle body 222 and the shroud 224. The swirler 226 serves to swirl the air flowing between the nozzle body 222 and the shroud 224. A fuel injection hole may be formed in the swirler 226.

The swirler 226 is bent at least once to have a curved surface. One fuel nozzle includes a plurality of swirlers 226 arranged annularly to surround the nozzle body 222.

Referring to FIG. 4, each of the swirlers 226 includes a leading edge **226*a* directed in an air inflow direction and a trailing edge 226*b* located opposite the leading edge 226*a***, i.e., directed in an air outflow direction.

Because the swirler 226 has a curved surface, the leading edge **226*a* and the trailing edge 226*b* are positioned so as not to overlap each other when viewed in the axial direction of the nozzle body 222**.

However, an amount of inflow and a flow rate of air are not uniform in all portions of the side fuel nozzle 220. Because the side fuel nozzle 220 is not located at a center of the fuel nozzle assembly, the flow rate of air flowing into a side, which is close to the casing 50, of the side fuel nozzle 220 (i.e., radially outward of the side fuel nozzle 220) is larger than the flow rate of air flowing into a side, which is close to the center fuel nozzle 210, of the side fuel nozzle 220 (i.e., radially inward of side fuel nozzle 220).

The compressed air supplied from the compressor 20 is introduced into a vicinity of the casing 50 and flows to the side fuel nozzle 220. Therefore, the flow rate of air flowing radially outward of the side fuel nozzle 220 is larger than that flowing radially inward of the side fuel nozzle 220.

As such, if the flow rate of air varies depending on the position in the side fuel nozzle 220, the flow of air passing through the swirler 226 is non-uniform, resulting in a deterioration in combustion efficiency.

In order to solve this problem, the exemplary embodiment is implemented to adjust a distance between the leading edges **226*a* of the respective swirlers 226, thereby making a uniform flow rate of air passing through the swirlers 226**.

Referring to FIG. 3, the side fuel nozzles 220 are spaced radially outward from the center fuel nozzle 210. Accordingly, any of the side fuel nozzles 220 has at least one swirler 226 positioned radially outward thereof and at least one swirler 226 positioned radially inward thereof. At least one of the plurality of swirlers 226 is configured such that the leading edge **226*a* thereof extends radially outward from the nozzle body 222 to reach the shroud 224, and at least the other of the plurality of swirlers 226 is configured such that the leading edge 226*a* thereof extends radially inward from the nozzle body 222 to reach the shroud 224**.

FIG. 6 is a top view of the side fuel nozzle when viewed from the leading edge thereof according to the exemplary embodiment. FIG. 7 is a top view of the side fuel nozzle when viewed from the trailing edge thereof according to the exemplary embodiment.

Referring to FIG. 6, the leading edge 226*a* extending radially outward from the nozzle body 222 is spaced apart from the leading edge 226*a* adjacent thereto by a distance A. Here, A is a length of an arc that interconnects centers of both leading edges 226*a*.

On the other hand, the leading edge 226*a* extending radially inward from the nozzle body 222 is spaced apart from the leading edge 226*a* adjacent thereto by a distance B. Here, B is a length of an arc that interconnects centers of both leading edges 226*a*.

As illustrated in FIG. 6, all angles formed between adjacent leading edges 226*a* are the same. That is, the distance between the leading edges 226*a* may be varied by adjusting only positions in which the leading edges 226*a* are coupled to the nozzle body 222, without adjusting the angle of each leading edge 226*a* itself.

However, alternatively, the distance between the leading edges 226*a* may be varied by adjusting the angle between adjacent leading edges 226*a*. In this case, the angle between the radially inward leading edges 226*a* is greater than the angle between the radially outward leading edges 226*a*.

Due to the different distances between the leading edges 226*a*, it is possible to adjust the flow rate of air introduced into the space between the swirlers 226. As described above, a larger amount of air is introduced into the space between the radially outward swirlers 226. Accordingly, if a larger space is defined between the radially inward swirlers 226 by adjusting the distance between the leading edges 226*a* thereof, the flow rates of air flowing in the respective spaces partitioned by the swirlers 226 may be equal to each other. Therefore, it is possible to accomplish a uniform flow rate of air in all regions regardless of direction.

However, as illustrated in FIG. 7, distances C between the trailing edges 226*b* are all the same. This is because the trailing edges 226*b* correspond to regions through which air flows in the state in which the flow rate of the air flowing through the spaces between the leading edges 226*a* has already been constantly adjusted therein. Therefore, in order to keep the flow rate of air, flowing into the combustion chamber, uniform, the distances between the trailing edges 226*b* have to be the same.

As a result, the swirlers 226 have different shapes (i.e., curvatures) that the distances between the leading edges 226*a* are different, but the distances between the trailing edges 226*b* are the same.

Here, eight swirlers 226 are provided in one side fuel nozzle 220, and each of the angles between the trailing edges 226*b* is thus 45 degrees.

Meanwhile, the distance between the leading edges 226*a* may be appropriately determined according to the size of the combustor to which the fuel nozzle assembly is applied, the number or size of side fuel nozzles 220, or the like according to the exemplary embodiment. If necessary, it is possible to appropriately determine the distance between the leading edges 226*a* by means of data on the amount of inflow and the flow rate of air flowing in the side fuel nozzles 220. Moreover, a shape of each swirler 226, other than the distances between the leading edges 226*a* and between the trailing edges 226*b*, may also be appropriately modified for the purpose of uniform flow of air.

On the other hand, the distances between the leading edges of the swirlers in the center fuel nozzle 210 are all the same. In addition, the distances between the trailing edges of the swirlers provided in the center fuel nozzle 210 are all the same as well. As described above, there is a difference in flow rate between the air flowing radially outward of each side fuel nozzle 220 and the air flowing radially inward of the side fuel nozzle 220. However, there is no difference in flow rate according to the direction in the center fuel nozzle 210.

Because the distances between the leading edges 226*a* of the swirlers 226 provided in each side fuel nozzle 220 are different from each other, the spaces between the leading edges 226*a* also have different sizes. In order to solve this problem, the radially outward space of the side fuel nozzle 220 through which a relatively larger amount of air flows is configured to be smaller than the radially inward space of the side fuel nozzle 220 through which a relatively smaller amount of air flows, thereby keeping the flow rate of air, introduced between the leading edges 226*a*, uniform. In addition, because the distances between the trailing edges 226*b* are all the same, the flow rate of air passing through the swirlers 226 is maintained uniformly in all regions. Therefore, it is possible to uniformly mix fuel and air and thus to increase combustion efficiency. Consequently, it is possible to enhance the overall efficiency of the gas turbine.

As described above, in the fuel nozzle assembly and the gas turbine combustor including the same according to the exemplary embodiments, it is possible to keep the flow rate of air uniform in the region in which the air has passed through the swirler in the side fuel nozzle. Therefore, the combustion efficiency in the combustor can be improved.

While exemplary embodiments have been described with reference to the accompanying drawings, it is to be understood by those skilled in the art that various modifications and changes in form and details can be made therein without departing from the spirit and scope as defined by the appended claims. Therefore, the description of the exemplary embodiments should be construed in a descriptive sense and not to limit the scope of the claims, and many alternatives, modifications, and variations will be apparent to those skilled in the art.

What is claimed is:

1. A fuel nozzle assembly comprising: an end plate coupled to one end of an annular casing; and a fuel nozzle configured such that one end thereof is supported by the end plate and the other end thereof extends outward, compressed air being supplied to the fuel nozzle through an inflow channel in the casing, wherein the fuel nozzle comprises a center fuel nozzle located at a center thereof and a plurality of side fuel nozzles arranged annularly to surround the center fuel nozzle, each of the plurality of the side fuel nozzles comprises a side fuel nozzle body located at a center thereof, a shroud spaced outward from the side fuel nozzle body and defining a flow path therebetween, and a plurality of swirlers located between the side fuel nozzle body and the shroud, each of the plurality of swirlers comprises a leading edge directed toward the end plate and a trailing edge located opposite the leading edge, and in each of the plurality of side fuel nozzles, distances between the leading edges are different from each other, and wherein each of the plurality of swirlers is bent at least once from the leading edge to the trailing edge, and wherein in any of the plurality of the side fuel nozzles, the bent portions of the swirlers have different curvatures.

2. The fuel nozzle assembly according to claim 1, wherein in each of the side fuel nozzles, a distance between the leading edges located radially inward of the fuel nozzle assembly is larger than a distance between the leading edges located radially outward of the fuel nozzle assembly.

3. The fuel nozzle assembly according to claim 2, wherein in any adjacent ones of the swirlers, distances between the trailing edges are the same.

4. The fuel nozzle assembly according to claim 1, wherein the side fuel nozzles are spaced apart from each other at equal intervals.

5. The fuel nozzle assembly according to claim 4, wherein each of the swirlers includes a cavity and a fuel injection hole which is formed on surface and is open from the cavity.

6. The fuel nozzle assembly according to claim 5, wherein the swirler is coupled in communication with the nozzle body so that some of the fuel flowing in the nozzle body is supplied to the cavity of the swirler and injected through the fuel injection hole.

7. The fuel nozzle assembly according to claim 4, wherein a diameter of the side fuel nozzle is larger than a diameter of the center fuel nozzle.

8. The fuel nozzle assembly according to claim 2, wherein an angle formed by adjacent leading edges in a region in which there is the largest one of the distances between the leading edges is greater than an angle formed by adjacent leading edges in a region in which there is the smallest one of the distances between the leading edges.

9. The fuel nozzle assembly according to claim 2, wherein at least one of the swirlers is configured such that the leading edge thereof is positioned to coincide with the radial direction of the fuel nozzle assembly.

10. The fuel nozzle assembly according to claim 9, wherein the swirlers include an even number of swirlers, and the leading edges are arranged to be symmetrical with respect to the radial direction of the fuel nozzle assembly.

* * * * *